US006925377B2

(12) United States Patent
Peters

(10) Patent No.: US 6,925,377 B2
(45) Date of Patent: Aug. 2, 2005

(54) TUNNEL MONITORING SYSTEM IN A VEHICLE TUNNEL

(76) Inventor: Goddert Peters, Tölzer Strasse 31, 82544 Deining (DE)

( * ) Notice: Subject to any disclaimer, the term of this patent is extended or adjusted under 35 U.S.C. 154(b) by 0 days.

(21) Appl. No.: 10/451,935

(22) PCT Filed: Dec. 21, 2001

(86) PCT No.: PCT/EP01/15273

§ 371 (c)(1),
(2), (4) Date: Jun. 25, 2003

(87) PCT Pub. No.: WO02/054368

PCT Pub. Date: Jul. 11, 2002

(65) Prior Publication Data

US 2004/0059503 A1 Mar. 25, 2004

(30) Foreign Application Priority Data

Dec. 30, 2000 (EP) ..... 00128758

(51) Int. Cl.[7] ..... G08G 1/08
(52) U.S. Cl. ..... 701/117; 701/119; 340/993
(58) Field of Search ..... 701/117, 118, 701/119; 340/993, 933, 934, 936, 943

(56) References Cited

U.S. PATENT DOCUMENTS 3,668,625 A * 6/1972 Wolf et al. ..... 340/936
4,789,941 A * 12/1988 Nunberg ..... 701/117
5,173,692 A * 12/1992 Shapiro et al. ..... 340/943
5,305,390 A * 4/1994 Frey et al. ..... 382/115
5,528,234 A * 6/1996 Mani et al. ..... 340/933
5,778,332 A * 7/1998 Chang et al. ..... 701/117
6,204,778 B1 * 3/2001 Bergan et al. ..... 340/905

FOREIGN PATENT DOCUMENTS

EP 0396432 A2 * 11/1990
JP 2001-103451 * 4/2001

* cited by examiner

*Primary Examiner*—Michael J. Zanelli
(74) *Attorney, Agent, or Firm*—McNair Law Firm, PA; Cort Flint

(57) ABSTRACT

A tunnel monitoring system for monitoring vehicles traveling through a tunnel having at least one vehicle traffic lane is disclosed comprising a plurality of ultrasonic sensors arranged in series in a longitudinal direction of the tunnel. The sensors have a detection zone covering a portion of the traffic lane for detecting the presence of a vehicle in the detection zone, and the ultrasonic sensors generate a vehicle sensor signal upon detecting a vehicle in the detection zone and a sensor identification signal identifying which sensor the sensor signal is transmitted from. The detection zones are projected and arranged in relation to the traffic lane to provide a generally continuous detection of the vehicles traveling though the tunnel. An evaluation unit receives the vehicle sensor signals and the sensor identification signals for monitoring traffic in the tunnel.

22 Claims, 3 Drawing Sheets

TUNNEL MONITORING SYSTEM IN A VEHICLE TUNNEL

BACKGROUND OF THE INVENTION

This invention relates to a tunnel monitoring system for monitoring vehicle traffic in a tunnel.

Tunnel monitoring systems of various designs for monitoring vehicles in a tunnel are generally known. A tunnel monitoring system is known, for example, in which fire reporting devices are installed in the longitudinal direction of the tunnel. This system is designed to detect and locate a possible fire in the tunnel, in particular a burning vehicle. This system can comprise controls actuating automatic warning devices, traffic guiding devices or locking devices in case of a detected fire. Such a monitoring system is suited exclusively for the recognition of dangerous situations due to fire.

Another prior tunnel monitoring system consists of several monitoring cameras installed at intervals along the tunnel. Assigned tunnel segments can be monitored visually, and events detected by a camera are shown on a screen at a tunnel monitoring command station and evaluated by a monitoring person. It is also a known method to install such monitoring cameras so as to be capable of swiveling, whereby a swiveling motion can be remote-controlled at the tunnel monitoring command station. Such a tunnel monitoring system with monitoring cameras is cost intensive in acquisition and maintenance. The function of camera lenses in particular is restricted when they become soiled by developing smoke in case of critical fires. Furthermore, the system automatic recognition and evaluation of imminent danger situations is not possible, or is only possible to a limited extent since a relatively long tunnel segment with possibly a number of vehicles is covered and autonomous image evaluation is difficult. Thus, the evaluation of the image information supplied by such a tunnel monitoring system becomes essentially the responsibility of a monitoring person at the tunnel monitoring command station with respect to recognition of dangerous situations, evaluation of the density of traffic, of travel speeds and distances kept, etc. Protection essentially depends on the individual alertness of a monitoring person, and rapid recognition of a dangerous situation together with required rapid responses is not ensured.

The two previously described known tunnel monitoring systems, the fire reporting devices and the monitoring cameras, can be used in the manner of locating sensors of vehicles to locate vehicles in normal operating and/or in dangerous situations, however with the necessary acceptance of the above-mentioned disadvantages and weaknesses of the system.

Another traffic monitoring system is disclosed in U.S. Pat. No. 5,528,234 in which data sensed by ultrasonic sensors is subjected to a statistic evaluation in a central station regarding vehicle speed and vehicle density. Based on this evaluation, the current traffic conditions are assessed. Traffic conditions can then be transmitted in form of messages from the central station. The operation of a specific vehicle is not considered in this case, so that this traffic monitoring system does not evaluate the current and precise data concerning specific traffic situations, but only the improvement of traffic safety.

In another tunnel monitoring system (JP-A 282 581) sound sensors are distributed and installed along the longitudinal course of a tunnel, whereby the immobility of a vehicle in the tunnel is detected and located. Control of problem-free passage of a vehicle through the tunnel is not possible with this system.

Accordingly, an object of the present invention is to provide a system for improving traffic safety in a tunnel for vehicle traffic.

SUMMARY OF THE INVENTION

The objectives of the invention are accomplished by locating sensors in the form of ultrasonic sensors having emitting and receiving zones projected on at least one travel lane. When a vehicle is present within the emitting and receiving zone of an ultrasonic sensor the sensor transmits a corresponding sensor signal together with a sensor identification signal to an evaluation unit. The evaluation unit comprises a running time measuring module to calculate a running time measurement between two or more zones by means of sensor signals generated at successive ultrasonic sensors at whose emitting and receiving zones the vehicle is present. By means of a subsequent sensor signal of an ultrasonic sensor downstream in the travel direction in the tunnel within whose emitting and receiving zone the traveling vehicle is later present, the travel time between at least these two ultrasonic sensors can be determined. For the measurement of running time, ultrasonic sensors immediately following each other or ultrasonic sensors at a further distance can be used for evaluation. Since the distances between the ultrasonic sensors used to measure running time are fixed and known, a speed signal for a given vehicle can be detected immediately downstream in a speed measuring module consisting essentially of a multiplicator.

Speed measurements are preferably taken in the manner indicated above for all vehicles entering the tunnel, whereby the measuring of running time is triggered by every vehicle as it passes a first ultrasonic sensor and is ended when passing the second associated ultrasonic sensor. The speed signal can be obtained very rapidly for every vehicle and can possibly be stored for further evaluation, whereby the measuring interval can be actuated again for a subsequent vehicle and for a new measurement of running time. Such measuring intervals can be provided one after the other in the length of the tunnel. From this, easily and quickly obtained data, such as average travel speeds or vehicle traffic density, can be determined.

With this arrangement a vehicle traveling at a particularly slow speed or a stopped vehicle can be found very quickly and automatically by determining a threshold value for the travel time between two associated ultrasonic sensors in the evaluation unit. With an additional evaluation of a sensor identification (ID) code signal associated with the current ultrasonic sensor, the location of a stopped vehicle, or of one traveling at a particular speed, can be detected automatically in the tunnel. A detected signal that does not change during a predetermined time span also provides an indication in the evaluation unit regarding a stopped vehicle.

In addition, the emitting and receiving zones of ultrasonic sensors following each other in the longitudinal direction of the tunnel adjoining each other at the vehicle detection zones are approximately equal to usual vehicle lengths in the longitudinal direction of vehicle travel. Thereby a continuous detection and monitoring of a lane without breaks is made possible over the entire tunnel length. In addition, only one vehicle can be detected within the emission and receiving zone of an ultrasonic sensor, so that a duplicate detection or the skipping of a vehicle is practically impossible. This renders the evaluation result especially certain and reliable.

Such a monitoring system can be produced from relatively inexpensive and functionally reliable components. Ultrasonic sensors in particular are relatively inexpensive, functionally reliable and low-maintenance transmission units that have proven themselves under difficult operating conditions, e.g., also in maritime applications. Such ultrasonic sensors are advantageously immune to dirt and other tunnel contaminants, and furnish usable sensor signals for the location of vehicles in case of fire or in the presence of smoke. In addition, the evaluation of the sensor signals, together with the respective sensor recognition signals, is relatively easy. Installation costs and operating costs are also relatively low.

The evaluation unit furthermore comprises a tracking module by means of which the exact vehicle passages are determined based on each individual vehicle. For this purpose, a first ultrasonic sensor senses a vehicle as it enters the tunnel and the passage of the vehicle is detected and monitored by the subsequent ultrasonic sensors all the way to the tunnel exit by means of a transfer and transmission circuit. A stopped vehicle can also be detected by means of such a tracking unit when the evaluation unit detects an interruption in the transfer from one ultrasonic sensor zone to the next ultrasonic sensor zone. The exact location can be determined together with an associated sensor ID signal.

The evaluation unit can furthermore comprise a distance measuring module whereby two sensor signals associated with vehicles and following each other are evaluated so that a relative distance can easily be determined.

In an especially preferred embodiment, the sensor signals of the ultrasonic sensors are also evaluated for their signal intensity to identify types of vehicles in the tunnel. Since different vehicle types reflect ultrasound at different intensities, different vehicles can thereby be recognized in a vehicle type recognition module. In this way it is advantageously possible to determine if a stopped vehicle is a motorcycle, a passenger car, or a truck, representing different danger potentials and requiring different responses. In addition, the vehicle type recognition can be used, e.g., for statistical purposes. In an embodiment, a counter by means of which the number of vehicles can be counted can simply be incorporated in the evaluation unit.

The above evaluations with the different mentioned modules can be integrated compactly in a known manner in an electronic evaluation system that can be adapted to actual installation conditions and can be provided with the necessary programming possibilities.

The ultrasonic sensors can be installed at the tunnel ceiling, whereby a row of functionally interconnected ultrasonic sensors are assigned to the lanes in one direction of travel. Preferably each sensor row is assigned to one single lane as well as to breakdown bays. For easy recognition of stopped vehicles it could also be possible to monitor two lanes in different travel directions with only one row of ultrasonic sensors installed above them. The assignment of a row of ultrasonic sensors to each separate lane in one travel direction results however in considerably more valid monitoring results. It is thereby in particular possible to recognize also a direction of travel so that possible ghost riders can be detected immediately. For an optimal arrangement, the distances between sensors can be up to approximately 10 meters whereby approximately 50 ultrasonic impulses can be emitted and received per second.

The sensor signals, in particular when also the intensity of the sensor signals is evaluated, must be digitalized in the usual manner for an electronic evaluation. Suitable analog to digital (A/D) converters are to be installed on the ultrasonic sensors and the digitalized signals are to be transmitted over a serial bus system to the evaluation unit. In order to ascertain from which ultrasonic sensor a given sensor signal originates, it is necessary to transmit a sensor identification (ID) signal together with the measured value signal in a known manner to the evaluation unit. For a simple installation a two-wire system can be used over which the ultrasonic sensors and the A/D converters can also be supplied with current. Especially advantageous, only one current supply within low-voltage zone is necessary for this so that no additional safety risks to the tunnel operation can be incurred from this. Alternatively, or in addition, a signal transmission from the ultrasonic sensors to the evaluation unit can also be provided by radio. Depending on conditions, the cost of installation can thus be further reduced and a clear signal transmission, even in case a cable may be destroyed in a fire, would be ensured.

Since evaluation results made available are substantially automated with the tunnel monitoring system according to the invention without need for a subjective evaluation by a monitoring person, it is also possible to automate the reactions to certain evaluation results. For this purpose a control unit may be connected to the evaluation unit by means of which traffic control and/or warning regulating devices installed before or in the tunnel can be triggered automatically in function of certain evaluation results. Safety is improved considerably because no possible human or individually caused time delay needs to be dealt with. Such regulating devices can be in the form of traffic lights, blinking lights, sirens, warning panels with controllable text, or other known guiding and warning systems, as well as tunnel safety devices. Announcements in the tunnel or via radio stations can also be triggered or initialized automatically.

The tunnel monitoring system can be used advantageously in road and/or rail tunnels. The simple structure makes easy and low-cost refitting in existing tunnels as possible as a completion of, or combination with, already existing monitoring installations.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
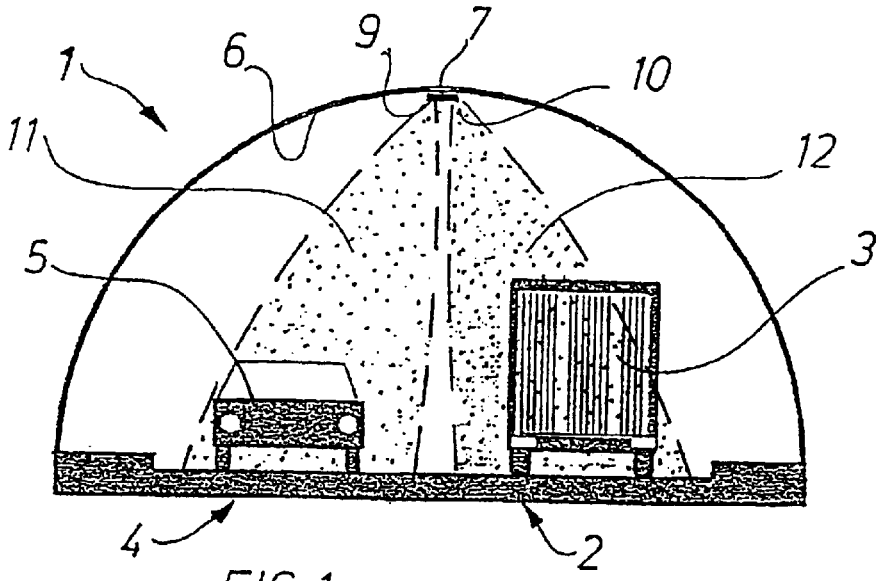
FIG. 1 is a cross-section taken across a tunnel having a tunnel monitoring system according to the invention.

Referring now to the drawings, the invention will now be described in more detail.

FIG. 1 illustrates a cross-section through a two-lane tunnel 1 for motor vehicles. A truck 3 is shown schematically on lane 2, on the right side of the tunnel cross-section, and a passenger car 5 is shown on lane 4 in the opposite direction. In a central area of a tunnel ceiling 6 ultrasonic sensor units 7 are installed and are placed at identical distances 8 between sensors in the longitudinal direction of the tunnel 1. Each ultrasonic sensor unit 7 comprises two ultrasonic sensors 9 and 10, these being adjacent to each other, with their respective vehicle detection zone in the illustrated form of a conical emitting and receiving zone 11, 12 directed upon the lane 2 and the lane 4 in opposite lateral directions. As can best be seen in FIG. 1, the vehicle detection zones 11, 12 cover the passing motor vehicles 3 and 5.

Figure 2:
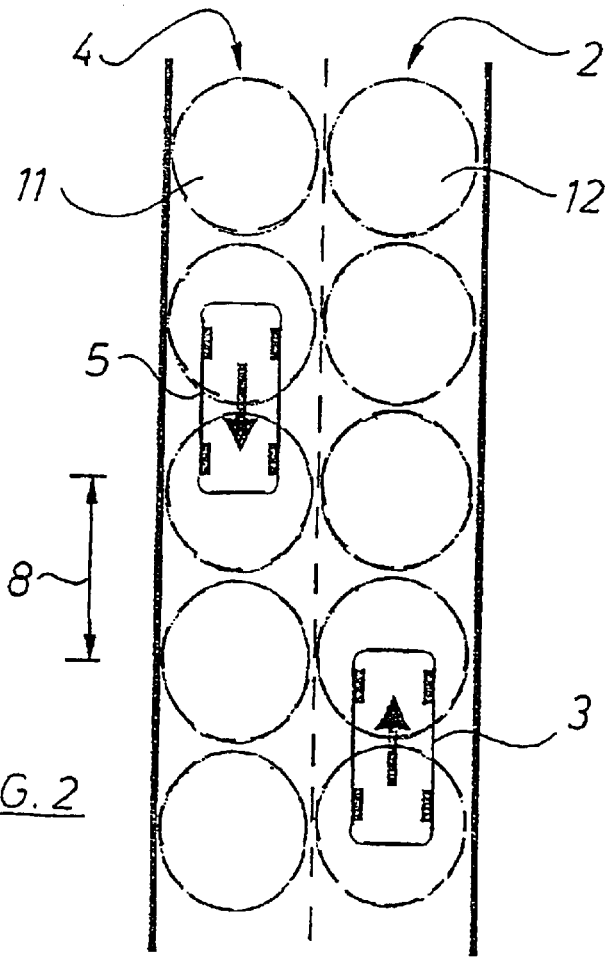
FIG. 2 is a top plan view of FIG. 1.

FIG. 2 illustrates a schematic top plan view of FIG. 1 with lane 2 and lane 3 in opposite directions of travel together with the vehicles 3 and 5. The approximately conical emitting and receiving zones 11, 12 project approximately circular areas on the lanes 2 and 4 as shown. The placement of the ultrasound sensors 9, 10 is such that the emitting and receiving zones 11, 12 nearly adjoin each other with respect to the drawn circles in longitudinal and transverse directions so that a generally continuous detection, without breaks of passing vehicles, is possible on the lanes 2 and 4. If necessary, the emitting and receiving zones of ultrasonic sensors may overlap slightly or be at a slight distance from each other. It is essential in this placement that the distances are chosen so as not to be so great that a vehicle could find room between these zones without being detected, or so close that several vehicles present in excessively large zones could possibly be detected as only one vehicle due to the zone overlaps.

Figure 3:
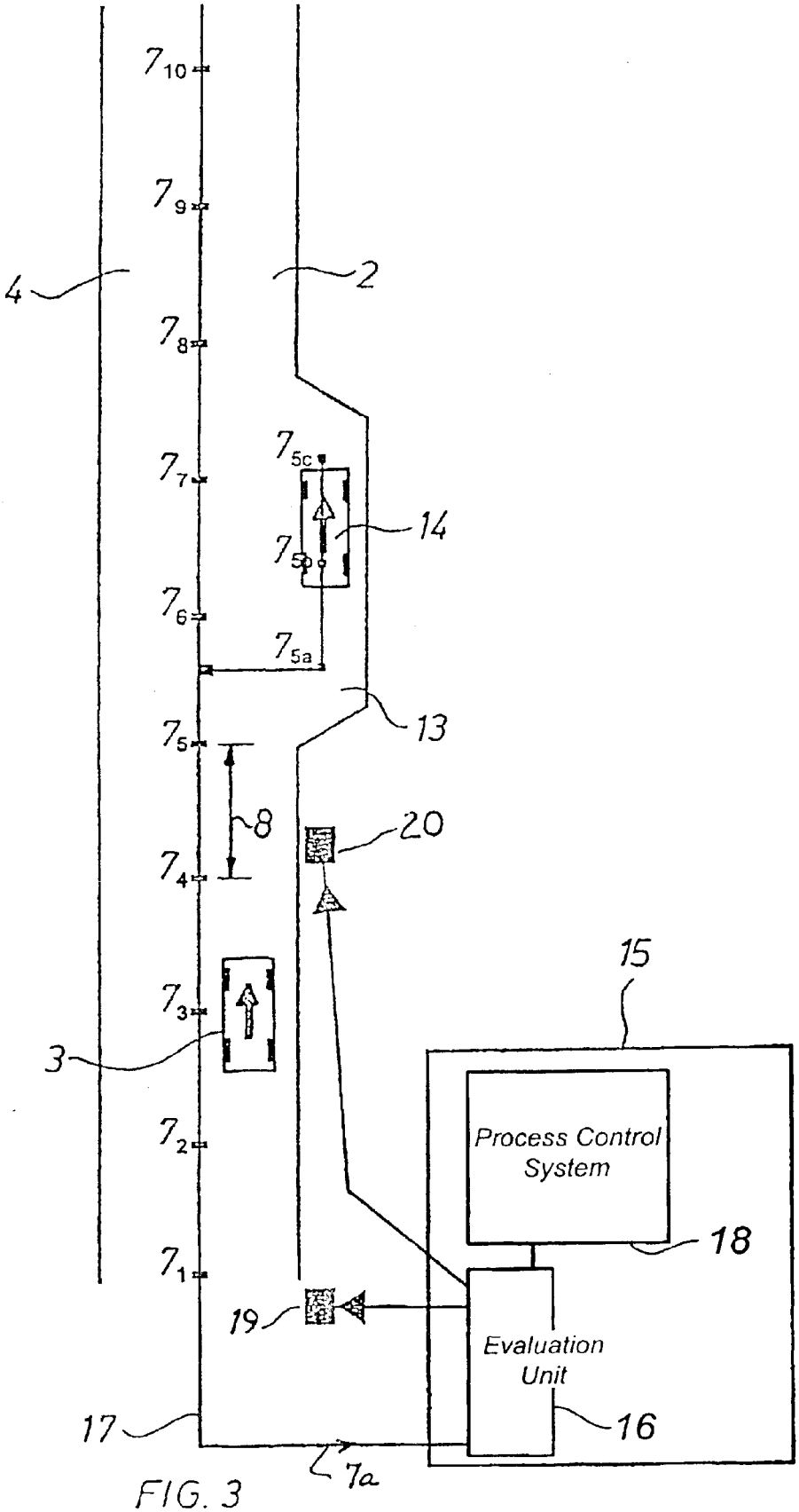
FIG. 3 is a schematic diagram illustrating the operation of the tunnel monitoring system according to the invention.

For purposes of example, FIG. 3 shows a functional diagram of the tunnel monitoring system with a schematic top plan view of the lanes 2 and 4. Ten ultrasonic sensor units $\mathbf{7}_1$ to $\mathbf{7}_{10}$ are installed in the longitudinal direction, with the possibility of the tunnel continuing further on. Within the zone of the ultrasonic sensor unit $\mathbf{7}_5$, a breakdown bay 13 is provided next to the lane 5 monitored by ultrasonic sensors $\mathbf{7}_{5a}$, $\mathbf{7}_{5b}$ and $\mathbf{7}_{5c}$. Truck 3 is shown on lane 2 and motor vehicle 14 has stopped in the breakdown bay.

An evaluation unit 16 is installed at a tunnel monitoring control point 15 for processing and evaluating sensor data. Each ultrasonic sensor unit 7 is connected to the evaluation unit, with their respective ultrasonic sensors 9, 10, via a serial bus 17. Each sensor unit has a unique identification (ID) code that is transmitted to the evaluation unit with other sensor data described below. The evaluation unit is connected to a process control system 18 for processing data from the evaluation unit, and includes visualization and documentation devices such as a display screen and data documentation devices. For additional utilization of the evaluation data and results, two control signals or outputs are provided and shown schematically as examples: one control signal relates to an entrance traffic light 19 at the tunnel entrance that can be switched to "red" in case of a stopped vehicle on lane 2 or when a traffic overload is detected. Another control output can be provided in the form of an information panel 20 in the tunnel as shown in the drawing for displaying traffic-directing instructions in blinking illuminated letters.

Figure 4:
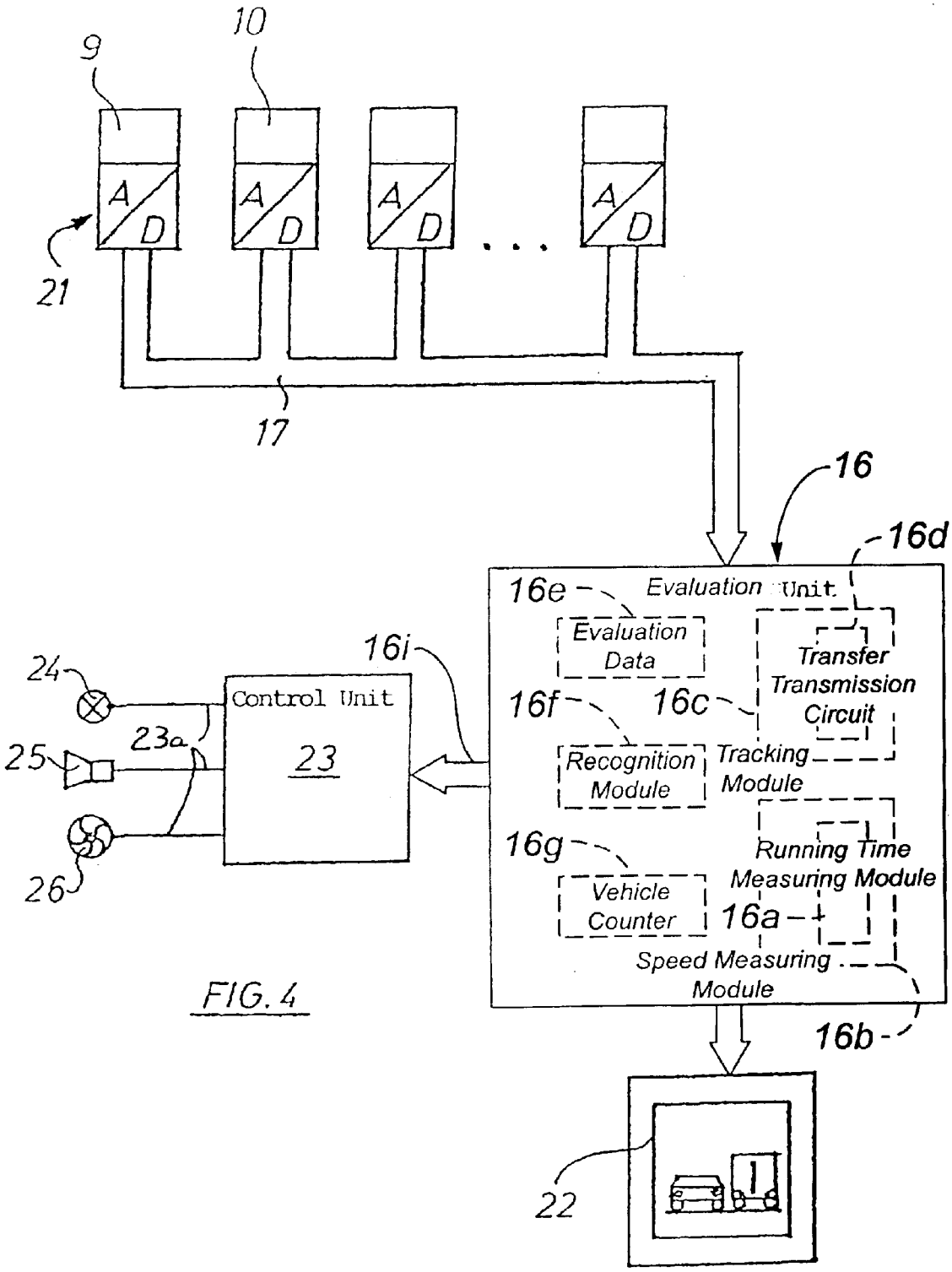
FIG. 4 is a block diagram of a tunnel monitoring system according to the invention.

FIG. 4 shows the example of a schematic block diagram of the tunnel monitoring system and logic process. Each of the different ultrasonic sensors 9,10 of the ultrasonic senor units 7 is assigned an analog-digital transformer 21 connected downstream via serial bus 17. Serial bus 17 communicates with evaluation unit 16. Evaluation unit 16 may be provided with several measuring and evaluation devices, modules, and program routines, possibly integrated with each other, depending on desired function and level of control. Evaluation unit 16 includes a running time measuring module 16*a* which calculates a vehicle running time between 2 or more zones. A sensor signal, is generated corresponding to the time at which a vehicle is present within an emitting and receiving zone of a first ultrasonic sensor. A subsequent sensor signal from an ultrasonic sensor downstream in the travel direction is generated when the vehicle is later present within that sensor's emitting and receiving zone. The travel time between these, at least 2, ultrasonic sensors is then determined. For the measurement of running time, ultrasonic sensors immediately follow each other or ultrasonic sensors at a further distance can be used for this determination. Since the distances between the ultrasonic sensors are known, a speed signal for a given vehicle can be detected immediately downstream by speed measuring module 16*b*. Speed measurements can be determined for each vehicle entering the tunnel and can be stored in computer memory for evaluation. In the illustrated embodiment, evaluation unit 16 includes a tracking module 16*c* for tracking exact vehicle passages through the tunnel for each individual vehicle. For this purpose, a first ultrasonic sensor senses a vehicle as it enters the tunnel and the passage of the vehicle is detected and monitored by subsequent ultrasonic sensors all the way to the tunnel exit by means of a transfer and transmission circuit 16*d*. The evaluation unit may include a distance measuring module 16*e* for measuring the distance between vehicles using the known distances between sensors and the running time. Evaluation unit 16 includes a vehicle recognition module 16*f* for determining the type of vehicle in the tunnel. By taking advantage of the fact that different vehicle types reflect ultrasound at different intensities, this information can be collected by the sensors and transmitted to the evaluation unit so that the different vehicles can be recognized as to their type in the tunnel. For example, it is possible to determine if a stopped vehicle is a motorcycle, a passenger car, or a truck. Advantageously, evaluation circuit 16 may also include a vehicle counter 16*g* for counting the number of vehicles passing through the tunnel using known techniques. As part of one or more of the above modules, a vehicle location device can be provided to determine the particular position of a vehicle in a particular omitting and receiving zone, and thus the exact location of the vehicle at any given time. Data 16*i* from the evaluation unit is input to programmed system controller 23.

The evaluation unit 16 may include a screen 22 as the display unit so that a monitoring person can visually observe the events in the tunnel. In addition, known units for documentation, such as computer data memories and printers are also possible. Evaluation results data 16*i* from evaluation unit 16 is transmitted to a control unit 23 where control signals 23*a* may be sent to actuate automatic traffic regulators, e.g., for traffic control, warning, safety measures, etc. For example, a lamp 24 may indicate traffic lights, blinking lamps, and/or illuminated letters. In addition, 25 indicates use of alarms, sirens, and/or message transmission devices schematically. An aeration wheel 26 is meant to cover such tunnel-safety devices as ventilation, automated fire extinguishing apparatus, locking devices, etc.

While a preferred embodiment of the invention has been described using specific terms, such description is for illustrative purposes only, and it is to be understood that changes and variations may be made without departing from the spirit or scope of the following claims.

What is claimed is:

1. A tunnel monitoring system for monitoring vehicles in a tunnel having at least one vehicle traffic lane, wherein the monitoring system includes vehicle locating sensors installed in the longitudinal direction of at least one lane (2,4) and distributed along the tunnel; an evaluation unit (16) to which sensor signals of the locating sensors can be transmitted; and an emitting unit downstream of the evaluation unit (16) by means of which evaluation results can be displayed; said monitoring system comprising:

a plurality of ultrasonic sensors (7, 9, 10) disposed along the length of said tunnel having an emitting and receiving zones (11, 12) directed over an area of at least one vehicle lane (2, 4) so that when a vehicle (3, 5) is present in the emitting and receiving zone (11, 12) of an ultrasonic sensor (7, 9, 10), said ultrasonic sensor generates and transmits a sensor signal (7*a*);

said emitting and receiving zones (11, 12) of ultrasonic sensors (7, 9, 10) following each other in the longitudinal direction of the tunnel (1) adjoin each other at vehicle detection zones that are shorter than a usual vehicle in the longitudinal direction of vehicle travel;

an evaluation unit (16) for receiving said sensor signals from said ultrasonic sensor; and a vehicle running time measuring module included in said evaluation unit using a first sensor signal from a first ultrasonic sensor (7, 9, 10) and a second sensor signal from a second ultrasonic sensor to determine the vehicle running time between said zones of said first and second sensors; and a speed measuring module included in said evaluation unit for determining the vehicle speed from the running time and the known distance between said sensors.

2. The system of claim 1, wherein the evaluation unit (16) comprises a tracking module by means of which a vehicle (3, 5) is detected by a first ultrasonic sensor as the vehicle enters the tunnel and passage of the vehicle by subsequent ultrasonic sensors can be detected and monitored by a transfer and transmission circuit to determine the vehicle's location; and said tracking module generating a stopping signal for the vehicles (3, 5) in response to a sensor ID signal identifying the location of an ultrasonic sensor which has not detected the vehicle causing an interruption of the transmission circuit.

3. The system of claim 2, wherein the evaluation unit (16) comprises a distance measuring module to which the sensor signals regarding two vehicles (3, 5) following each other can be generated for the determination of a relative distance between the vehicles by using the known distances between sensors.

4. The system of claim 3, wherein the evaluation unit comprises a vehicle recognition module to which current sensor signals can be transmitted and can be evaluated based on a determined signal intensity for identifying the type of vehicle.

5. The system of claim 4, wherein the evaluation unit comprises a vehicle counter to which sensor signals from at least one ultrasonic sensor can be transmitted for the counting of detected vehicles (3, 5).

6. The system of claim 1 wherein said ultrasonic sensors (7, 9, 10) are installed on the tunnel ceiling (6) and including a row of functionally interconnected ultrasonic sensors (7, 9, 10) assigned to a lane (2, 4) of one direction of travel.

7. The system of claim 6 wherein the tunnel includes at least one breakdown bay to the side of a lane of traffic, and including a row of said ultrasonic sensors are associated with said breakdown bay.

8. The system of claim 6 wherein said ultrasonic sensors include sensor units, each said sensor unit having first and second sets of a sensor emitter and a sensor receiver, and said first set being associated with a first traffic lane and said second set is associated with a second traffic lane.

9. The system of claim 1 wherein said ultrasonic sensors (7, 9, 10) comprise an analog-digital converter (21) in communication with the evaluation unit (16) via a serial bus system (17).

10. The system of claim 9, wherein said evaluation unit (16) is followed by a control unit (23) for actuating one of a traffic directing device and a warning control device associated with the tunnel automatically as a function of evaluation results.

11. The system of claim 1 wherein said that the tunnel monitoring system is used in one of a road and rail tunnel.

12. The system of claim 1, wherein the evaluation unit (16) comprises a tracking module by means of which a vehicle (3, 5) is detected by a first ultrasonic sensor as the vehicle enters the tunnel and passage of the vehicle by subsequent ultrasonic sensors can be detected and monitored by a transfer and transmission circuit to determine the vehicle's location; and said tracking module generating a stopping signal for the vehicles (3, 5) in response to a sensor ID signal identifying the location of an ultrasonic sensor which has not detected the vehicle causing an interruption of the transmission circuit.

13. The system of claim 1, wherein the evaluation unit (16) comprises a distance measuring module to which the sensor signals regarding two vehicles (3, 5) following each other can be generated for the determination of a relative distance between the vehicles by using the known distances between sensors.

14. The system of claim 1, wherein the evaluation unit comprises a vehicle recognition module to which current sensor signals can be transmitted and can be evaluated based on a determined signal intensity for identifying the type of vehicle.

15. A tunnel monitoring system for monitoring vehicles traveling through a tunnel having at least one vehicle traffic lane comprising:

a plurality of ultrasonic sensors arranged in series in a longitudinal direction of said tunnel, said sensors having a detection zone covering a portion of said traffic lane for detecting the presence of a vehicle in said detection zone, and said ultrasonic sensors generating a vehicle sensor signal upon detecting a vehicle in said detection zone and a sensor identification signal identifying which sensor the sensor signal is transmitted from;

said detection zones being projected and arranged in relation to said traffic lane to provide a generally continuous detection of said vehicles traveling though said tunnel; and an evaluation unit receiving said vehicle sensor signals and said sensor identification signals and for monitoring traffic in the tunnel, said evaluation unit including one of a vehicle speed measuring module for determining the speed of the vehicles traveling through the tunnel, a vehicle tracking module for determining the location of a vehicle at a given instance in the tunnel including whether the vehicle has stopped in the tunnel, a vehicle recognition module for determining the type of vehicles traveling through the tunnel, a distance measuring module for determining the relative distance between vehicles, and a counter for counting the vehicles traveling through the tunnel.

16. The system of claim 15, wherein said evaluation unit comprises said vehicle tracking module receiving a first sensor signal from a first ultrasonic sensor as the vehicle enters the tunnel and subsequent sensor signals during passage of the vehicle by subsequent ultrasonic sensors, said vehicle tracking module having a transfer and transmission circuit for transferring said sensor signal from one zone to another, and said transfer circuit generating a stop signal indicating the vehicle is stopped when a sensor signal is not transmitted by a subsequent sensor as identified by said ID signal of that sensor.

17. The system of claim 15, wherein said evaluation unit comprises said vehicle recognition module for determining the type of vehicle based on the intensity of said sensor signal generated by an ultrasonic sensor.

18. The system of claim 15 wherein said ultrasonic sensors include sensor units, each said sensor unit having first and second sets of a sensor emitter and a sensor receiver, and said first set being associated with a first traffic lane and said second set is associated with a second traffic lane.

19. The system of claim 15, wherein said ultrasonic sensors comprise analog-digital converters in communication with said evaluation unit via a serial bus system; and including a control unit connected to said evaluation unit for actuating one of a traffic directing device and warning control device associated with the tunnel automatically as a function of evaluation results.

20. A tunnel monitoring system for monitoring vehicles in a tunnel having at least one vehicle traffic lane, wherein the monitoring system includes vehicle locating sensors installed in the longitudinal direction of at least one lane (2,4) and distributed along the tunnel; an evaluation unit (16) to which sensor signals of the locating sensors can be transmitted; and an emitting unit downstream of the evaluation unit (16) by means of which evaluation results can be displayed; said monitoring system comprising:

a plurality of ultrasonic sensors (7, 9, 10) disposed along the length of said tunnel having an emitting and receiving zones (11, 12) directed over an area of at least one vehicle lane (2, 4) so that when a vehicle (3, 5) is present in the emitting and receiving zone (11, 12) of an ultrasonic sensor (7, 9, 10), said ultrasonic sensor generates and transmits a sensor signal **(7*a*)**;

said ultrasonic sensors (7, 9, 10) carried near the tunnel ceiling (6) and including a row of functionally interconnectted ultrasonic sensors (7, 9, 10) assigned to a lane (2, 4) of one direction of travel;

said tunnel including at least ors breakdown bay to the side of a lane of traffic, and including a row of said ultrasonic sensors associated with said breakdown bay;

an evaluation unit (16) for receiving said sensor signals from said ultrasonic sensor;

a vehicle running time measuring module included in said evaluation unit using a first sensor signal from a first ultrasonic sensor (7, 9, 10) and a second sensor signal from a second ultrasonic sensor to determine the vehicle running time between said zones of said first and second sensors; and a speed measuring module included in said evaluation unit for determining the vehicle speed from the running time and the known distance between said sensors.

21. A tunnel monitoring system for monitoring vehicles in a tunnel having at least one vehicle traffic lane, wherein the monitoring system includes vehicle locating sensors installed in the longitudinal direction of at least one lane (2,4) and distributed along the tunnel; an evaluation unit (16) to which sensor signals of the locating sensors can be transmitted; and an emitting unit downstream of the evaluation unit (16) by means of which evaluation results can be displayed; said monitoring system comprising:

a plurality of ultrasonic sensors (7, 9, 10) disposed along the length of said tunnel having an emitting and receiving zones (11, 12) directed over an area of at least one vehicle lane (2, 4) so that when a vehicle (3, 5) is present in the emitting and receiving zone (11, 12) of an ultrasonic sensor (7, 9, 10), said ultrasonic sensor generates and transmits a sensor signal **(7*a*)**;

an evaluation unit (16) for receiving said sensor signals from said ultrasonic sensor;

a vehicle running time measuring module included in said evaluation unit using a first sensor signal from a first ultrasonic sensor (7, 9, 10) and a second sensor signal from a second ultrasonic sensor to determine the vehicle running time between said zones of said first and second sensors; and a speed measuring module included in said evaluation unit for determining the vehicle speed from the running time and the known distance between said sensors; and said evaluation unit (16) comprising a tracking module by means of which a vehicle (3, 5) is detected by a first ultrasonic sensor as the vehicle enters the tunnel and passage of the vehicle by subsequent ultrasonic sensors can be detected and monitored by a transfer and transmission circuit to determine the vehicle's location; and said tracking module generating a stopping signal for the vehicles (3, 5) in response to a sensor ID signal identifying the location of an ultrasonic sensor which has not detected the vehicle causing an interruption of the transmission circuit.

22. A tunnel monitoring system for monitoring vehicles in a tunnel having at least one vehicle traffic lane, wherein the monitoring system includes vehicle locating sensors installed in the longitudinal direction of at least one lane (2,4) and distributed along the tunnel; an evaluation unit (16) to which sensor signals of the locating sensors can be transmitted; and an emitting unit downstream of the evaluation unit (16) by means of which evaluation results can be displayed; said monitoring system comprising:

a plurality of ultrasonic sensors (7, 9, 10) disposed along the length of said tunnel having an emitting and receiving zones (11, 12) directed over an area of at least one vehicle lane (2, 4) so that when a vehicle (3, 5) is present in the emitting and receiving zone (11, 12) of an ultrasonic sensor (7, 9, 10), said ultrasonic sensor generates and transmits a sensor signal **(7*a*)**;

an evaluation unit (16) for receiving said sensor signals from said ultrasonic sensor;

said evaluation unit (16) comprising a distance measuring module to which the sensor signals regarding two vehicles (3, 5) following each other can be generated for the determination of a relative distance between the vehicles by using the known distances between sensors; and a vehicle running time measuring module included in said evaluation unit using a first sensor signal from a first ultrasonic sensor (7, 9, 10) and a second sensor signal from a second ultrasonic sensor to determine the vehicle running time between said zones of said first and second sensors; and a speed measuring module included in said evaluation unit for determining the vehicle speed from the running time and the known distance between said sensors.

* * * * *